United States Patent [19]

DePauli

[11] Patent Number: 4,963,793

[45] **Date of Patent: * Oct. 16, 1990**

[54] DELAYED RESPONSE TOUCH SWITCH CONTROLLER

[75] Inventor: John F. DePauli, San Diego, Calif.

[73] Assignee: Westek Associates, San Diego, Calif.

[ * ] Notice: The portion of the term of this patent subsequent to Jul. 3, 2007 has been disclaimed.

[21] Appl. No.: 165,591

[22] Filed: Mar. 8, 1988

Related U.S. Application Data

[63] Continuation-in-part of Ser. No. 148,767, Jan. 26, 1988.

[51] Int. Cl.[5] ..... H01J 7/66; H05B 37/02; H05B 41/04

[52] U.S. Cl. ..... 315/74; 315/291; 315/DIG. 4; 315/360; 315/362

[58] Field of Search ..... 307/116, 114; 315/74, 315/291, 194, 199, DIG. 4, 362, 360

[56] References Cited

U.S. PATENT DOCUMENTS

| | | | |
|---|---|---|---|
| 4,160,192 | 7/1979 | McAllise | 315/360 X |
| 4,359,670 | 11/1982 | Hosakia et al. | 315/307 |
| 4,508,997 | 4/1985 | Woodnutt | 315/360 |
| 4,649,323 | 3/1987 | Pearlman et al. | 315/307 |

*Primary Examiner*—Eugene R. Laroche
*Assistant Examiner*—Ali Neyzari
*Attorney, Agent, or Firm*—Brown, Martin, Haller & McClain

[57] ABSTRACT

The present invention provides a very low actuation force touch control switch for use in brightness control of illumination devices. The control switch comprises a flexible membrane having a plurality of conductors disposed on one surface and secured to a rigid support surface. The conductors are interwoven in a present pattern with portions of the conductors being exposed. A conductive surface is formed in an area under the exposed conductors. The membrane is fastened to the rigid support surface so that a very small spacing is maintained between the exposed conductors and the fixed conductive surface, allowing a very light touch to cause one or more exposed conductors to be shorted to the conductive surface. A microprocessor periodically polls the leads of the membrane to determine which are shorted together and causes an output power level to be adjusted accordingly. The touch control system employs a Delayed-Off feature in which the microprocessor causes a discernible dimming to occur when a DELAYED-OFF selection are on the memberane is pressed but which delays the turning off of the illumination device until a preselected amount of time has passed, thereby allowing a switch operator to leave an area before becoming dark. In addition, Soft-On and Soft-Off processing is employed so that on and off transitions are more gradual and aesthetically pleasing and to provide a period in which to select an alternate brightness level.

20 Claims, 4 Drawing Sheets

DELAYED RESPONSE TOUCH SWITCH CONTROLLER

CROSS REFERENCE TO RELATED APPLICATIONS

The present application is a continuation in part of application Ser. No. 148,767 filed on Jan. 26, 1988.

BACKGROUND OF THE INVENTION

1. Field of the Invention

The present invention relates to electrical switches and controllers and more particularly to a touch actuated switching system that provides delayed response timing for termination of electrical power to a controlled device. The invention further relates to a touch control system allowing selection between a plurality of alternate ON states, an OFF state, and a delayed OFF state for an illumination device.

2. Background of the Art

Touch control switching systems, especially for controlling illumination devices, have proven appealing due to their added convenience and aesthetics. However, incorporation of multiple power level dimming schemes in such systems or switches has typically required use of complex touch or contact sequences which have proven annoying or to difficult to remember and use for noncommercial applications.

To decrease the operational complexity by decreasing the number of discrete contact elements that must be separately touched during operation, a class of switches based on membrane contacts were developed. In membrane switching a series of switch contact is are manufactured on the surfaces of one or more adjacent membranes which are deformed into contact by touch. This allows a series of contact elements or patterns to be built into a relatively compact structure which is operated by touching an exterior surface which generally hides the underlying contact structure. A variety of otherwise complex power or lighting level control schemes are accommodated through a specific, and complex, interconnection of contacts without requiring knowledge by the switching system user. The user only needs to follow a simple contact pattern on an exterior surface which is interpreted by the more complex underlying pattern of switch contacts.

However, present membrane switching techniques have a number of drawbacks which seriously limit their suitability for many applications. One drawback is a requirement for relatively high actuation forces which reduces their aesthetic appeal and their utility for users having limited hand or finger mobility or strength. A second drawback is the generally complex multi-layered construction techniques for present membrane switches which adds to their cost and complexity.

At the same time, an inadequacy of all prior techniques for switching lights is that switching systems automatically turn lights completely off before a system user can leave the room or building. Thus, the user must fumble in the dark to leave the previously illuminated area or leave a light on.

What is needed is a method and apparatus for proving touch actuated control over the brightness or light output of lamps or similar illumination devices that is easy to use and provides a more convenient output scenario when adjusting to an off state.

SUMMARY OF THE INVENTION

One purpose of the present invention is to provide a touch sensitive controller that allows a delayed off response.

Another purpose of the present invention is to provide a touch control switching system that allows ready adjustment or reinstatement of illumination levels after a an off command.

An advantage of the present invention is the provision for a period of partial illumination after receiving an off command to allow safe exit from a lighted area.

Another advantage of the prevent invention is the provision of easy reactivation of the illumination pattern after requesting an off state.

The present invention provides a touch control system which is actuable by a very light touch while allowing a large number of switching gradations or control sequences.

These and other purposes, advantages, and objects of the present invention are realized if a touch control system comprising a pad with multiple interleaved conductors disposed on a semi-flexible material which is generally mounted on a very rigid base or support structure. The semi-flexible membrane is attached directly to the rigid base with a thin layer of adhesive which serves as a spacer, leaving portions of the interleaved conductors exposed. The rigid base has a recessed portion in which a conductive element is mounted and positioned so that it is directly beneath exposed portions of the conductors printed on the semi-flexible membrane. Because of the extremely small spacing between the membrane and the rigid base and because of the rigidity of the base, a very light touch causes exposed conductors to come in contact with the conductive element, shorting them together. Because of the extremely small spacing provided by this construction technique, an extremely light touch is required to actuate the switch rendering it far more aesthetically pleasing and more suitable for use in many applications.

In one embodiment of the invention, a precision recess is molded into a rigid plastic base, which precisely accommodates the thickness of a hot-stamped or printed-on conductor. The interleaved conductors are mounted above this conductor and constantly polled or monitored by a microprocessor to determine which are shorted together. The microprocessor provides a control signal to a triac which alters an controlled output power level according to which conductors are shorted together. Using lithographic techniques to form the conductors, a complex pattern of interleaving can be achieved and a large number of gradations created and nearly continuous power control may be provided.

A Delayed-Off feature is implemented by interleaving at least two of the conductors in a DELAYED-OFF selection area on the flexible membrane and using conduction between these conductors to initiate a delayed response turn off operation. When the Delayed-Off mode is initiated by touch contact, the power output level is immediately decreased, dimming any controlled light, to indicate to the user that the Delayed-Off has taken effect. The microprocessor holds this power level and counts a fixed period of time before turning off the lamp. Thus, a person has time to leave the room before the room goes dark.

In addition, the microprocessor utilizes a short period decreasing power level ramp to turn off illumination devices connected to the controller.

BRIEF DESCRIPTION OF THE DRAWINGS

The novel features of the present invention may be better understood from the accompanying description when taken in conjunction with the accompanying drawings in which like characters refer to like parts and in which.

DETAILED DESCRIPTION OF A PREFERRED EMBODIMENT

The present invention provides a touch control switch or power controller that provides several adjustable levels of output power to a controlled device such as a lamp or other source of illumination and allows a time delayed response to OFF commands. In addition, during execution of OFF commands the illumination device is ramped to a zero power level over a short period rather than abruptly turned off. These steps are accomplished if a touch control switch assembly employing a low activation force switch with a series of patterned conductors positioned above a conductive surface. The conductors are connected to a control circuit for monitoring conduction between the conductors and providing an output control signal to an output power device in response to conduction patterns or sequences.

Figure 1:
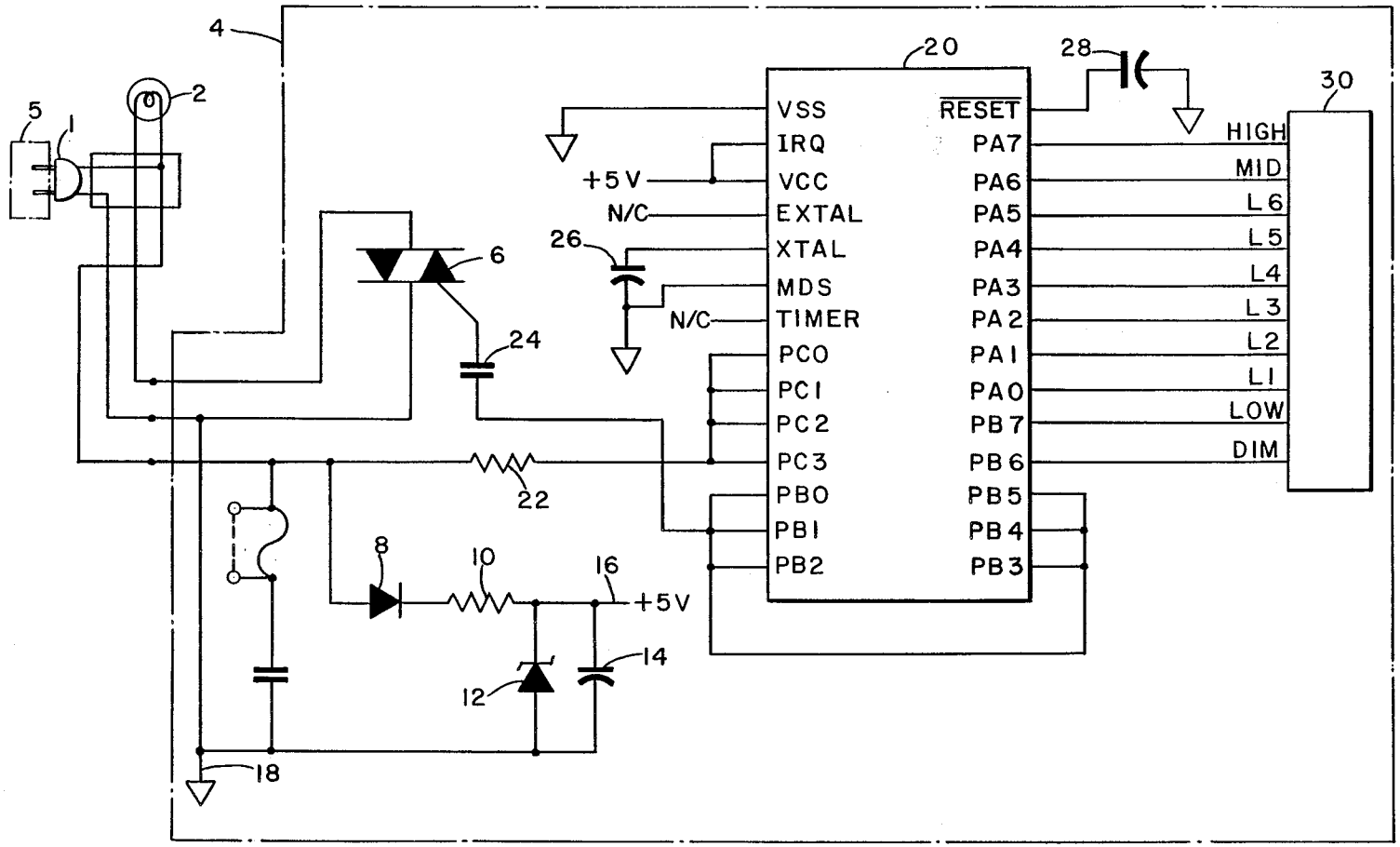
FIG. 1 illustrates a schematic diagram of control circuitry used in one embodiment of the present invention.

A schematic diagram depicting control circuitry constructed and operating according to the principles of the present invention is illustrated in FIG. 1. In FIG. 1, a controller is shown having an interface plug 1 connected between a lamp 2, or other illumination device, and a source of electricity 5 such as a typical wall or floor outlet (not shown).

A typical application for the present invention is for controlling the brightness of household lamps and lighting fixtures operating at 110 volts AC. Therefore, the electrical source 5 is described as providing 110 volt AC current at approximately 60 Hertz which is standard household voltage and frequency in the United States. However, the method of the invention is also applicable to other voltage levels up to 220 volts and operating frequencies such as 50 Hertz with adjustments to components as would be obvious to those skilled in the art.

The interface plug 1 is configured to act as a receptacle for a matching electrical plug (not shown) for the lamp 2. The interface plug 1 is generally polarized with one contact blade oriented to connect to a neutral or grounded side of the electrical source 5 and a second blade connected to a hot side. Electricity from the neutral or grounded side is connected directly to both a first input of the controlled lamp 2 and a control circuit or controller 4. The second or hot side of the electrical source 5 output is connected to a second input of the control circuit 4 which is in turn connected to a second electrical input of the controlled lamp 2.

As shown in FIG. 1, the control circuit 4 uses a triac 6 interposed between the second electrical source connection and the controlled lamp 2. A microprocessor 20 is used in the control circuit 4 to determine the various operating levels for the lamp 2 and provide control signals to the triac 6.

An exemplary microprocessor 20 useful in constructing the present invention is a microprocessor manufactured by the Motorola Company under the designation of model numbers 6804, HC 6804 or 68HC6804. This processor has the advantage that it is a low power CMOS type device which is organized as an eight-bit central processor with an internal instruction set that efficiently handles the required control functions or instructions of the present invention.

Of course, the exact microprocessor used and the operating frequency and port configurations may be altered so long as required operating programming is provided. The exemplary HC6804 microprocessor employs a series of internal storage registers, an accumulator, an internal timer, ROM type memory, and 32–128 bytes of RAM which are available in other microprocessors. However, the present invention only requires a few hundred bytes of ROM to implement along with 4–8 internal registers, a timer, an accumulator and associated support elements, allowing less complex microprocessors to be employed. In the alternative, an Application Specific Integrated Circuit (ASIC) is constructed which incorporates only the specific amount of ROM, RAM, and other elements, including discrete components like timing capacitor 26 (see below). The manufacture of an ASIC reduces cost through reduced complexity and may require less power to operate.

The microprocessor 20 operates in five volt electrical power which is typically derived from the 110 volt input through a diode 8, resistor 10, zener, diode 12 and capacitor 14. The diode 8 supplies semi-rectified current which is limited by a the resistor 10 which has a resistance of approximately 10 kilo-ohms. A zener diode 12, with a zener breakdown voltage of approximately 5 volts, is connected between the output of the resistor 10 and ground and clamps the voltage between a power supply point 16 and ground point 18 to 5 volts.

The capacitor 14 has a capacitance of approximately 200 microfarads which acts to smooth out the semi-sinusoidal signal provided through the diode 8 which provides a fairly high quality or well regulated positive 5 volt supply voltage to power supply node 16. Because the ground 18 is connected to the other side of at 110 volt power supply voltage, power supply node 16 floats at 5 volts above the nominal 110 volts AC power from the electrical source 5.

In the preferred embodiment, power supply voltage is also provided to microprocessor 20 through a resistor 22 to all four input terminals of port C (labeled PC0–PC3) of the exemplary microprocessor 20. The resistance of the resistor 22 is approximately 1 meghms, which limits the current to a value which will not damage microprocessor 20. Integrated circuits generally contain voltage protection diodes which clamp input voltages above Vcc to Vcc+1.6 volts on the internal circuitry of the integrated circuit and similarly with voltages below 0 volts the voltage supplied to the integrated circuit is clamped to Vss −1.6 volts. Because of the input protection devices, what microprocessor 20 actually sees is a square wave input going from nominally 0 to 5 volts.

Microprocessor 20 controls the operation of triac 6 through capacitor 24. During periods when triac 6 is off, output terminals P80 through P85 are maintained at a high, 1, logic level, i.e., 5 volts. When microprocessor 20 is to turn on triac 6, output terminals P80 through P85 go to a low, 0, logic level, i.e. 0 volts. The charge stored on the capacitor 24 is discharged into a P-type injection port of triac 6 which causes triac 6 to turn on. Output ports PB0 through PB5 then return to the high or 5 volt level and the capacitor 24 is recharged by internal leakage through the triac 6.

The capacitor 26 adjusts or sets the operating frequency of microprocessor 20. The microprocessor 20 has an internal clock generation circuit whose operating frequency is adjusted by an external capacitor.

A capacitor 28 is connected to the reset input terminal to prevent stray fields from generating a reset signal in the microprocessor 20.

Figure 2:
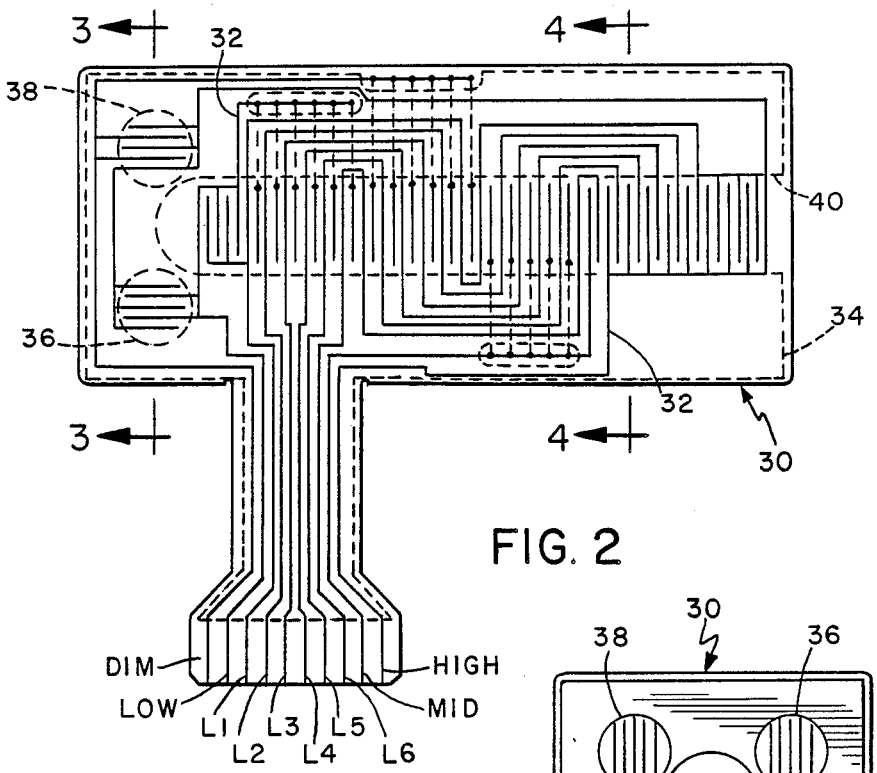
FIG. 2 illustrates a schematic pattern for conductors used on a membrane in a touch control switch constructed according to the present invention.

Microprocessor terminals PB6, PB7 and PA0 through PA7 are connected to a series of dim, low, L1 through 6, mid and high leads of a touch switch 30. A layout of a membrane portion of the touch switch 30 is shown in FIG. 2. As shown in FIG. 2, the dim, low, mid and high leads of the switch 30 cross a power level control area 40 covering 4 sections of dimmer area 40. Leads L1 through L6 interweave through the dim, low, mid, and high leads in a serpentine fashion. The dim lead is interwoven with the high lead in an OFF selection area 38 and the low and high leads are interwoven in a DELAYED-OFF selection area 36. A printed insulator 34 covers all leads excepting in areas 36, 38 and 40. In these areas the leads are exposed.

Figure 3:
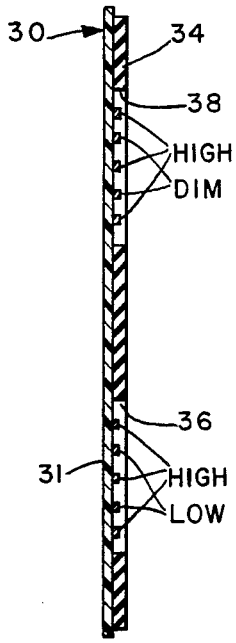
FIG. 3 is an enlarged sectional view taken on line 3—3 of FIG. 2.
Figure 4:
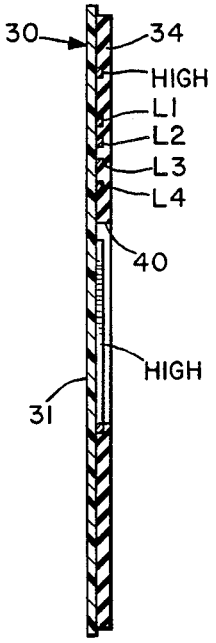
FIG. 4 is an enlarged sectional view taken on line 4—4 of FIG. 2.
Figure 5:
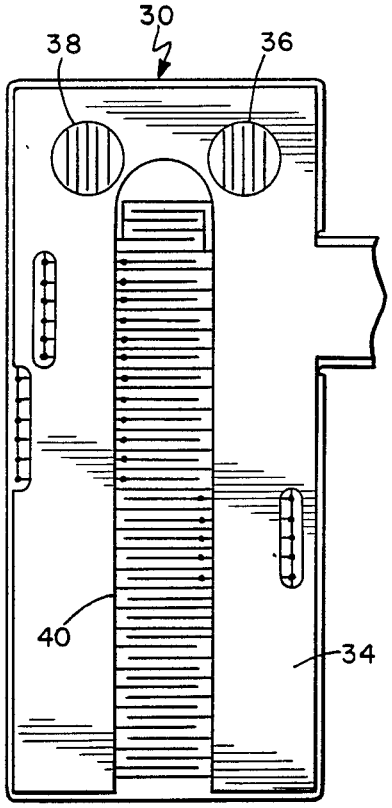
FIG. 5 is a view of the rear face of membrane 30 of FIG. 2.

FIG. 3 is a sectional view of membrane 30 showing the exposed low, dim and high leads. These leads are supported by substrate 31 but are not covered by insulation 34 in this selection area. FIG. 4 is a section of membrane 30 taken along line 4—4 of FIG. 2. FIG. 4 shows how leads L1 through L4 and the high lead are insulated by insulation 34 but lead HIGH is exposed in opening 40. FIG. 5 is a rear view of membrane 30 through substrate 31.

Figure 6:
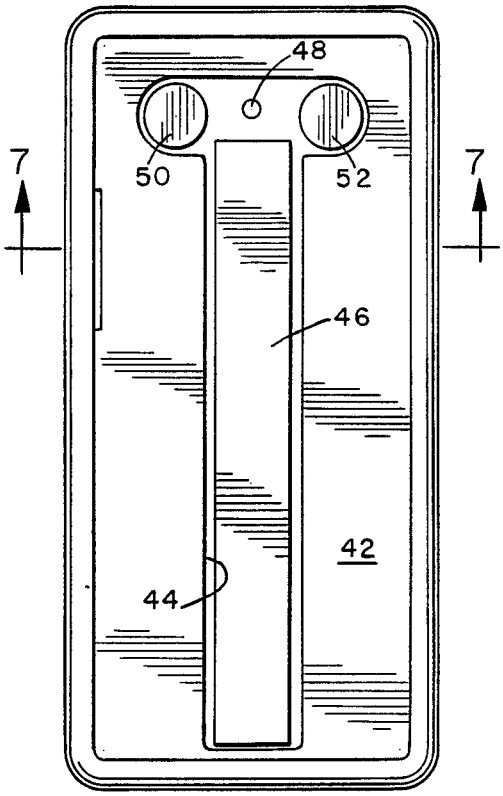
FIG. 6 is a top plan view of the base for membrane 30 of FIG. 2.

FIG. 6 is a top view of base 42. Recess 44 is a flat recess approximately 2 mils below the flat surface of base 42. Conductor area 46 is formed in recess 44. In a preferred embodiment conductor 46 is formed by carbonized paint. Conductors 50 and 52 are formed in a simi)ar manner. Ventilation hole 48 is included to avoid alteration of the tolerances between membrane 30 (FIG. 2) and base 42 due to variations in ambient temperature and/or barometric pressure changes when membrane 30 is adhesively placed on the surface of base 42.

Figure 7:
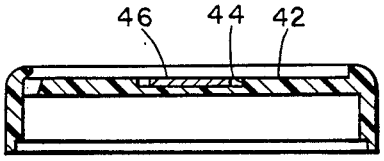
FIG. 7 is a sectional view taken on line 7—7 of FIG. 6.

FIG. 7 is a side view of base 42 and conductor 46.

Figure 8:
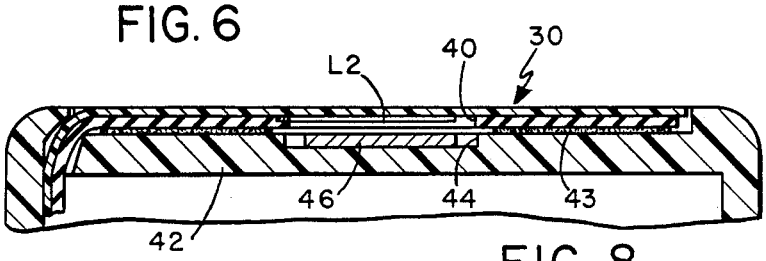
FIG. 8 is an enlarged sectional view similar to FIG. 7, with membrane 30 attached.

FIG. 8 is a side view showing membrane 30 attached to base 42 by adhesive 43. Because of the extreme rigidity of base 42, which is preferably formed with high rigidity plastic, this spacing tolerance between the exposed leads of membrane 30 and conductor regions 46, 50 and 52 can be very small on the order of 50 microns or less. Because of this small tolerance, a very light touch approximately one half ounce, is required to cause connection between the leads formed on membrane 30 and conductor regions 46, 50 and 52. Because of this tight tolerance, membrane 30 must be formed of a plastic such as mylar which is resistant to moisture and temperature alterations of size and shape and membrane 30 must be fastened to the surface of base 42 using an adhesive 43 such as the 467 adhesive by 3M Corporation which is also moisture and temperature stable.

In the described embodiment, adhesive 43 acts as a spacer between membrane 30 and base 42 to provide precise spacing between membrane 30 and conductor regions 46, 50 and 52. Alternatively, adhesive 43 is made thicker, approximately 7 mils, and recess 44 is eliminated. In this alternative embodiment, the adhesive itself provides all the required spacing between the conductors of membrane 30 and conductor regions 46, 50 and 52.

Figure 9:
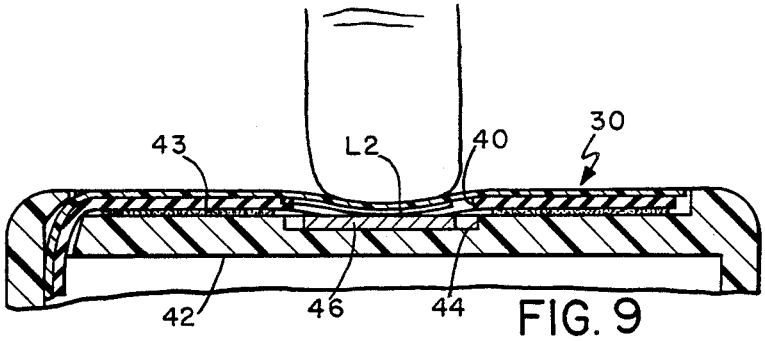
FIG. 9 is a view similar to FIG. 8, showing the contact action.

To activate the touch control switch of the present invention and select an illumination setting, manual pressure is applied on the top of the membrane 30. When pressure is directed on the membrane 30 above conductor region 46, as shown in FIG. 9, one or more of the leads L1 through L6 will be shorted to one of more of dim, low, mid and high leads through conductor 46. Microprocessor 20 is programmed so that a logical 0 is placed on each of the dim, low, mid and high leads, successively and leads L1 through L6 are normally at a logical 1. Microprocessor 20 then polls terminals PA0 through PA5 to determine if conductivity is present between the selected dim, low, mid and high lead and one of the leads L1 through L6. If continuity is found, that fact is stored in a register within microprocessor 20 and is used as timing data for triggering the triac 6.

The controller 4 and, thus, the microprocessor 20 are powered on as long as the interface plug 1 is connected to an electrical source 5. To preserve aesthetics no separate ON switch is used, although possible. This means that the controller 4 is always ready to receive new commands or brightness level requests from the switch membrane 30, subject to polling timing described below.

Figure 10:
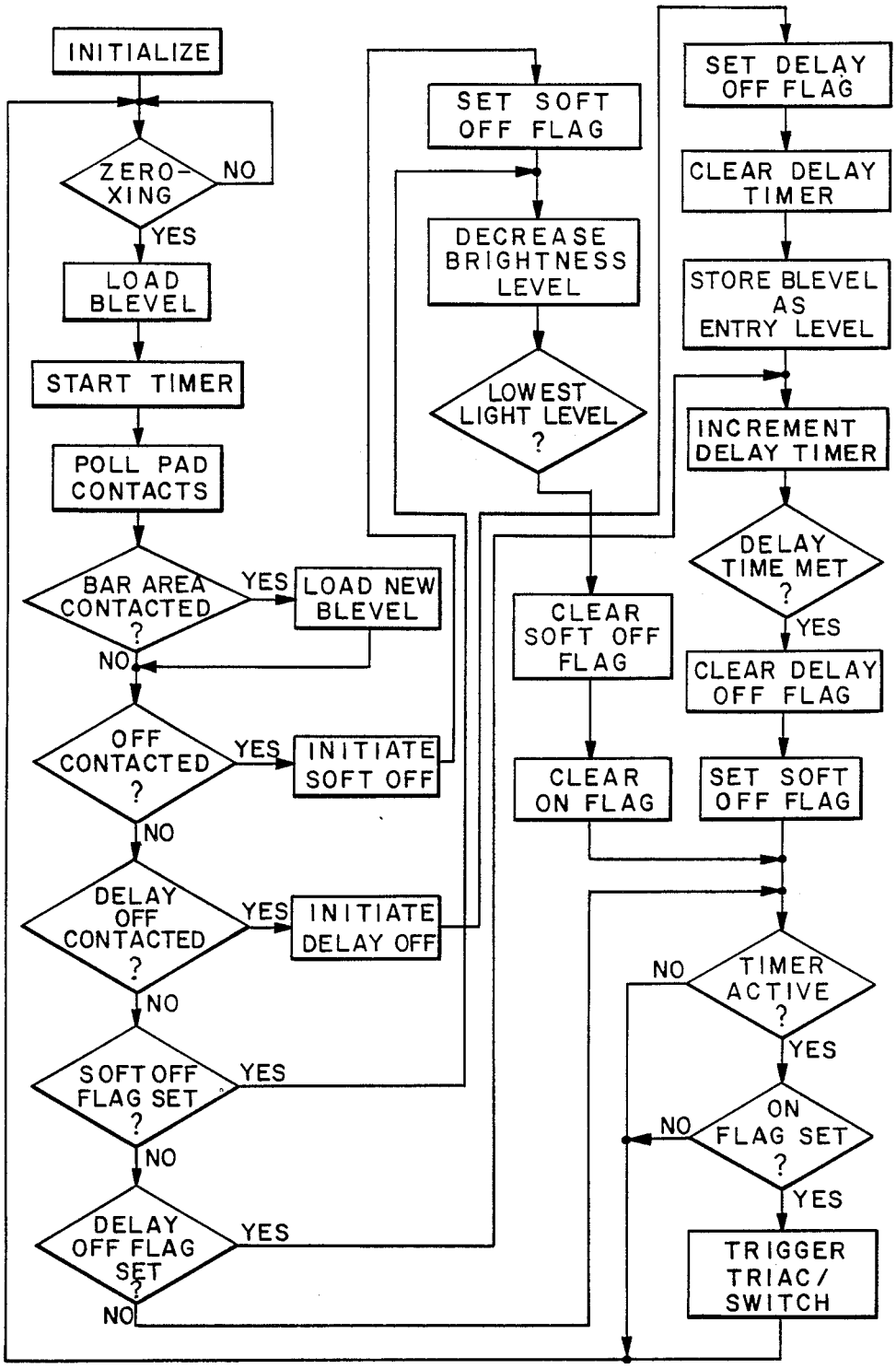
FIG. 10 illustrates a flow diagram of the steps employed by the control circuitry of FIG. 1.

The operation of the microprocessor 20 and associated support elements and leads low through high are better understood from viewing the flow diagram of FIG. 10 in conjunction with the circuit of FIG. 1.

The microprocessor 20 is initialized or initializes the controller 4 on initial power up so that the microprocessor port A leads PA0–PA5, port B leads PB6–PB7 and port C leads PC0–PC3 are set or configured as inputs; and port A leads PA6–PA7, and port B leads PB0–PB5 are set as outputs, except for polling commands as used below. The voltage on the PC0–PC3 leads, from register 22, are defined as high and the PB1–PB5 and PA6–PA7 leads set at a high or 1 logic level. A system status register is loaded with a multi-bit command which contains bits defining system status for certain basic operating parameters. These parameters are lamp ON or OFF, Soft-On feature active or inactive, polarity for the triac 6 (low positive, high negative), Delayed-Off active or inactive, and Soft-Off inactive or active. Initially these values are set as OFF, inactive, low, inactive, and inactive.

Additional registers, such as a register BLevel are set for establishing an initial Brightness Level. The BLevel register is initially loaded with a value on the order of 5.6 milliseconds of delay. The BLevel register value is also loaded into a Timer Counter Register TCR.

As the line voltage connected to plug 1 passes through one half cycle of the sinusoidal alternating current provided by the electrical source, microprocessor 20 (FIG. 1) detects zero voltage cross over transitions through input terminals PC0 through PC3. These cross over points are used as markers or flags to prompt a processing cycle for the microprocessor 20 operating instructions or program.

The operating frequency of microprocessor 20 is approximately 125 kilohertz which is approximately 2000 times the operating frequency of standard household current. The exemplary HC 6804 microprocessor requires on average four clock cycles to perform a given command or instruction. Therefore, the microprocessor 20 executes approximately 500 instructions for every cycle of the power source 5 and approximately 250 instructions every one-half cycle. The one-half cycle period representing the time between zero voltage cross over points for the sinusoidal AC current source. As before, the value of capacitor 26 can be altered to establish an alternate timing cycle for the microprocessor 20 where other electrical sources are used.

During a given half-cycle, the longer triac 6 remains off, the lower the average power received by lamp 2 and the dimmer the lamp 2 will be. Conversely, the longer the lamp 2 is turned on the brighter it will be. Thus, when the microprocessor 20 is set to provide a particular brightness setting, microprocessor 20 adjusts the amount of delay time that passes into each half-cycle before the triac 6 is turned on. The lowest intensity or brightness setting typically translates to about 6.7 milliseconds of delay before allowing triac 6 to turn on and at the brightest setting, microprocessor 20 allows triac 6 to turn on about 1.6 milliseconds after the start of a half cycle. This 1.6 millisecond delay is used to allow microprocessor 20 to poll the required leads of membrane 30 to determine if a new setting or brightness has been selected and perform necessary program steps.

At the start of each half cycle or 1.6 millisecond delay period, the microprocessor 20 begins operation by pulling or strobing the PA7 lead low to poll the various input leads and determine their conductivity with PA07. The microprocessor 20 also starts an internal timer which is used to set the firing time for the triac 6.

With the PA7 lead pulled low, the touch pad is checked for brightness commands by checking one level of each of the leads PA0–P5 one at a time. If any of the leads are in a low state then a time delay value associated with that lead is loaded into the BLevel register. For the preferred embodiment, the levels associated with conductivity between lead PA7 and the PA-0–A5 leads is on the order of 2.0, 3.0, 3.2, 3.4, 3.5, and 3.6 milliseconds respectively. The microprocessor 20 then sets the PA7 lead high and the PA6 lead is strobed low. The PA5–PA0 leads are again checked, this time in descending order, and another series of associated values loaded into the BLevel register. These values are 3.7, 3.8, 3.9, 4.0, 4.1, and 4.2 milliseconds respectively. Note that the lowest or smallest delay values are checked first so that the brightest setting specified by touching the touch pad is selected first to the exclusion of other or contradictory commands during a given polling cycle. Once a brightness level is selected and loaded into the BLevel register a new brightness level cannot be selected until the next cross over point.

The above procedure is used with leads PB6 and PB7 by setting them as outputs and strobing them to a low value and checking the leads PA1–PA5 and then PA5--PA1 respectively. The values loaded into the BLevel register when these leads are detected as low are 4.3, 4.4, 4.5, 4.6, 4.7, 4.8, 4.8, 4.9, 5.0, 5.1, 5.2, and 5.3 milliseconds respectively.

The microprocessor 20 then changes or sets the PB6–PB7 leads to inputs with the PA7 lead then strobed low. The leads PB7 and PB6 are checked to determine if contact has been made in the OFF selection area 36 or DELAYED-OFF selection area 38.

Of the 26 combinations between the dim, low, mid, and high leads, and the leads L1 through L6 on the membrane 30, twenty-four are used to define gradations or levels of brightness for the lamp 2 and two are used to define "OFF" and "DELAY-OFF" states or commands. The differences in brightness between adjacent levels are very difficult to perceive by the human eye, thus the variations in levels appear to be a continuous scale. Because of the light touch and the continuous scale appearance of the control switching system, the described embodiment provides a lamp dimming system with the tactile qualities of touch lamp control and the aesthetic qualities of continuous dimming.

The microprocessor 20 continues to monitor or poll the leads PA0–PA5 on a periodic basis and detects any new commands or requests for altered brightness. If a new level command is detected then a value for the corresponding delay from zero point cross over is transferred into the BLevel register which is used to determine the timing for firing the triac 6.

While the variations in brightness as implemented by the present invention advance the art, additional features are provided by the method and apparatus of the invention which prove most useful.

One such feature is the implementation of a Soft-Start technique for initially turning on the lamp 2 after being turned off. In the Soft-Start or Sott-On mode of operation the microprocessor 20 retrieves the current brightness level from the BLevel register and saves it in a temporary Command Level (ComLevel) storage register. The ComLevel value, from the BLevel register, is used as a target brightness level unless the touch control user sets a new level. The target level is adjusted if a different one is requested by a control user before the ComLevel value is reached.

Typically the BLevel value is then set at a very low level, say on the order of 5.6 milliseconds of delay as set initially in the BLevel register. This means that the initial average power delivered to the lamp 2 is very low which results in a dim light level. The BLevel value or number is then decreased by subtracting 32 microseconds from the BLevel register value and reloading the new value into the BLevel register on each microprocessor 20 instruction cycle. At the beginning of each microprocessor instruction cycle the new BLevel value is compared to the value stored in ComLevel to see if the target level has been reached. If it has, Soft-On processing is completed. Otherwise, the Soft-On processing continues until completed, and does so to the exclusion of other level changes or commands. Once the microprocessor 20 has adjusted the triac 6 to achieve the desired brightness level, the appropriate bit in the system status register is set low to indicate that the Soft-on processing routine is to be ignored in subsequent operational checks and program steps until the light is turned off. Another useful feature of the present invention is the implementation of the converse procedure called Soft-Off or Slow-Off which is used for added safety and aesthetics. When a touch control user wishes to turn the lamp off immediately, the portion of membrane 30 labeled area 38 in FIG. 2 may be pressed. During the 1.6 millisecond polling cycle of the microprocessor 20, conductivity between the dim and high leads is checked. If microprocessor 20 detects conductivity between these two leads the current value of the BLevel register is stored in an Entry Level (ELevel) register. The value in the ELevel register is used as the new BLevel and a flag or bit set in the status register to indicate that Soft-Off is active (and Delayed-Off is inactive, see below).

On each successive microprocessor instruction cycle, 32 microseconds is added to the delay value in the BLevel register and stored in the BLevel register until a targeted low value is reached. The low value is prestored in ROM and can be as low as the lowest value or 5.6 milliseconds, or any other suitably low value. It will take on the order of 250 half-cycle periods of the electrical source 5 to reach the lowest brightness value from the highest value. This is approximately 4 seconds. The time to reach a minimum brightness level from other brightness levels is, of course, shorter.

This Soft-Off feature allows time to hit another setting where the OFF selection portion of the membrane 30 was touched in error. This is especially useful for the present invention since a very light touch is all that is required to activate the switching control of the present invention unlike previous designs. If desired a double touch of the OFF selection portion of the membrane can be used to accelerate the OFF ramp by providing continued polling and additional changes in the values stored in the BLevel register.

Another feature of the present invention is activated by pressing the DELAYED-OFF selection area 38 of the membrane 30 so that the microprocessor 20 detects conductivity between the low and high leads and enters a Delayed-Off program. If Delayed-Off is selected by shorting the leads PA7 and PB6 together a flag bit is set in the status register to set Delayed-Off active, and the Soft-Off bit is also set inactive. Delay timer or control bits are set low and the current brightness setting or level is loaded from the BLevel register into an Entry Level (ELevel) register and sets a value in the Delay register (DLevel). The ELevel value is used as the starting point for the delayed-off operation.

The microprocessor 20 automatically adjusts the brightness level to dim the lamp 2 in response to the Delayed-Off request as a confirmation of the command. The exact drop in brightness level depends upon the current brightness. If BLevel is the highest brightness setting then the this level is decreased by two levels, i.e. down to 5.3 milliseconds. Otherwise, this level is decreased a smaller amount which varies according to how far down the brightness level BLevel is. That is, a smaller incremental change in timing is required to have a noticeable impact on the light brightness at lower levels so a smaller decremental value is used.

A preselected value for decreasing brightness at lower levels is programmed in the read only memory of microprocessor 20 and is selected so that perceptible dimming is provided no matter what the brightness setting of lamp 2 may be.

The new brightness level is stored in BLevel and in an Entry Level register. The microprocessor 20 checks to see if BLevel changes due to a user input, as where the user seeing the light dim, realizes that DELAYED-OFF was touched in error or has a change of mind. If BLevel has changed, then the Delayed-Off processing is discontinued. If there is no level change or command, the microprocessor 20 retrieves a countdown value from the DLevel register, adds one and stores the new value in the DLevel register. The value in the DLevel register is compared to a fixed time interval to see if enough time has elapsed to turn off the lamp 2. The value chosen for the fixed delay period is about 30 seconds. This is approximately equivalent to 3600 counts in the delay register based on the 120 Hertz operating clock rate discussed above.

The Delayed-Off state allows a present amount of time for a lamp user to either leave the area (room, building) or initiate a new brightness level. The amount of time is determined by a value stored in ROM and is typically set to approximately 30 seconds. This value is somewhat arbitrary and is established according to average need. However, this value can also be determined by an R-C timing constant or similar voltage level which is monitored by the microprocessor 20. Therefore, a small variable resistance device could be connected to a lead of the microprocessor 20 and adjusted to alter the time delay where desired.

Once the delay register value reaches the targeted value the microprocessor 20 proceeds with the Soft-Off feature. In this mode the microprocessor 20 changes the level setting every few cycles until the level is reduced to zero. In the alternative, the microprocessor 20 can also detect a secondary request by touching the area 36 which is interpreted to mean the lamp should go OFF completely and immediately thus overriding soft off and time delay off.

Although specific embodiments are herein described, the use of specific embodiments is not to be construed as limiting the scope of the invention. The scope of the invention is limited only by the claims appended hereto.

What I claim as my invention is:

1. A system adapted for coupling between an electrical appliance and an electrical power source for controlling the level of power applied to said appliance, comprising:

switch means, responsive to a user input indicative of a user requested level of operation of said appliance, for providing a corresponding switch signal, said switch means comprising:

a flexible membrane;

a plurality of spaced apart electrical pattern conductors disposed in a continuous single column array upon a first surface of said membrane;

a plurality of electrically conductive level leads disposed upon said membrane, each level lead coupled to a respective other one of said conductors in each respective region of said conductor array;

a rigid member having a flat surface, a recessed portion of said rigid member surface aligned and facing said conductor array; and a fixed conductor formed in said recessed portion, said membrane being attached to said rigid member with said conductor array suspended over said recessed portion so that certain ones of said pattern conductors come in contact with said fixed conductor when pressure is applied to a second surface of said member above said recessed portion;

control means for receiving said switch signal and responsive thereto for generating a control signal during each of a continuous sequence of equal time intervals, said control signal in each time interval of a duration corresponding to said user requested level of operation of said appliance;

power conditioning means for receiving electrical power from said power source and for receiving said control signal, said power conditioning means responsive to said control signal for coupling electrical power to said appliance; and said switch means further responsive to a user request for delayed turn-off of said appliance for providing a corresponding delayed-off signal, said control means responsive to said delayed-off signal for generating said control signal of a reduced duration, relative to a current control signal duration, during each time interval for a predetermined time period after which said control means inhibits generation of said control signal.

2. The system as in claim 1, wherein said power conditioning means is a triac.

3. The system as in claim 1 wherein said control means is a microprocessor.

4. The system of claim 1 wherein said control means, in response to a change in said switch signal corresponding to a change in a user request for a change in level of appliance operation, changes said control signal duration for each time interval until said control signal duration corresponds to said user requested level of appliance operation.

5. The system of claim 4 wherein said user request is an increase in level of appliance operation, said control signal duration linearly increases during each time interval.

6. The system of claim 4 wherein said user request is a decrease in level of appliance operation, said control signal duration linearly decreases during each time interval.

7. A low pressure electrical switch as in claim 1 wherein said flexible membrane comprises a mylar membrane.

8. The low pressure electrical switch of claim 1 further comprising a spacer layer disposed between said rigid member and said membrane, said spacer layer having an open portion aligned with said conductor array and said fixed conductor.

9. A low pressure electrical switch as in claim 1 wherein said fixed conductor is formed by depositing a carbon conductor in said recessed portion.

10. An illumination control system comprising:

(a) a low pressure electrical switch comprising:

a flexible membrane;

at least two patterned conductors printed on said flexible membrane;

a rigid member having a flat surface, a recessed portion of said surface aligned with an exposed portion of said patterned conductors; and a fixed conductor formed in said recessed portion, said membrane being attached to said flat surface and said exposed portion of said patterned conductors suspended over said recessed portion so that said patterned conductors come in contact with said fixed conductor when pressure is applied to said membrane in an area overlying said recessed portion;

(b) first and second power leads connected to an alternating current power source;

(c) a lamp having first and second lamp leads, said first lamp lead connected to said first power lead;

(d) switching means having a first and second power handling terminal and a control terminal, said first power handling terminal connected to said second lamp lead, said second power handling terminal connected to said power lead, and said control input for receiving a control signal, said switching means for in response to said control signal for coupling electrical power between said first and second power handling terminals so as to illuminate said lamp; and (e) control means having a first input port connected to said electrical switch patterned conductors, a second input port connected to said first and second power leads, and an output port connected to said switching means control terminal, said control means for generating a control signal beginning a selected time interval after the beginning of each cycle of said alternating current power source and terminating at the end of each corresponding cycle of said alternating current power source, said time interval selected according to connection of certain ones of said patterned conductors with said fixed conductor, and wherein said control means is further responsive to connection of certain other ones of said patterned conductors with said fixed conductor, indicative of a user request for a delayed turn-off in illumination of said lamp, said control means generating said control signal at a time later in each cycle of said alternating current power source for a predetermined period of time after which generation of said control signal is inhibited.

11. A low pressure electrical switch as in claim 10 wherein said flexible membrane comprises a mylar membrane.

12. A low pressure electrical switch as in claim 10 further comprising a spacer placed between said flexible membrane and said rigid member providing precise spacing between said patterned conductors and said fixed conductor.

13. A low pressure electrical switch as in claim 10 wherein said fixed conductor is formed by depositing a carbon conductor in said recessed portion.

14. The system of claim 10 wherein said switching means comprises a triac.

15. The system of claim 10 wherein said control means comprises a microprocessor.

16. A light dimming system comprising:

(a) a low pressure electrical switch comprising:

a flexible membrane;

at least two patterned conductors printed on said flexible membrane;

a rigid member having a flat surface;

a spacer layer attached to said flat surface of said rigid member, said spacer layer having an open portion aligned with an exposed portion of said patterned conductors; and a fixed conductor formed on said flat surface of said rigid member aligned with said opening in said spacer layer, said membrane being attached to said flat surface of said rigid member with said exposed portion of said patterned conductors facing and suspended over said fixed conductor so that said exposed portion of said patterned conductors come in contact with said fixed conductor when pressure is applied to said membrane in an area above said fixed conductor;

(b) first and second power leads connected to an alternating current power source;

(c) a lamp having first and second lamp leads, said first lamp lead connected to said first power lead;

(d) switching means having a first and second power handling terminal and a control terminal, said first power handling terminal connected to said second lamp lead, said second power handling terminal connected to said second power lead, and said control input for receiving a control signal, said switching means for in response to said control signal for coupling electrical power between said first and second power handling terminals so as to illuminate said lamp; and (e) control means having a first input port connected to said electrical switch patterned conductors, a second input port connected to said first and second power leads, and an output port connected to said switching means control terminal, said control means for generating a control signal beginning a selected time interval after the beginning of each cycle of said alternating current power source and terminating at the end of each corresponding cycle of said alternating current power source, said time interval selected according to connection of certain ones of said patterned conductors with said fixed conductor, and wherein said control means is further responsive to connection of certain other ones of said patterned conductors with said fixed conductor, indicative of a user request for a delayed turn-off in illumination of said lamp via complete decoupling of electrical power between said first and second power handling terminals, said control means generating said control signal of a shorter duration and beginning at a time later in each cycle of said alternating current power source for a predetermined period of time after which generation of said control signal is inhibited.

17. A low pressure electrical switch as in claim 16 wherein said flexible membrane comprises a mylar membrane.

18. A low pressure electrical switch as in claim 16 wherein said fixed conductor is formed by depositing a carbon conductor in said recessed portion.

19. The system of claim 16 wherein said switching means comprises a triac.

20. The system of claim 16 wherein said control means comprises a microprocessor.

* * * * *